US008443816B2

(12) United States Patent
Degennes

(10) Patent No.: US 8,443,816 B2
(45) Date of Patent: May 21, 2013

(54) KIT FOR APPLYING A COSMETIC COMPOSITION

(75) Inventor: Nicolas Degennes, Paris (FR)

(73) Assignee: L V M H Recherche, Saint Jean de Braye (FR)

( * ) Notice: Subject to any disclaimer, the term of this patent is extended or adjusted under 35 U.S.C. 154(b) by 213 days.

(21) Appl. No.: 12/518,248

(22) PCT Filed: Dec. 7, 2007

(86) PCT No.: PCT/EP2007/063547

§ 371 (c)(1), (2), (4) Date: Jul. 24, 2009

(87) PCT Pub. No.: WO2008/068337

PCT Pub. Date: Jun. 12, 2008

(65) Prior Publication Data

US 2010/0024836 A1 Feb. 4, 2010

Related U.S. Application Data

(60) Provisional application No. 60/873,273, filed on Dec. 7, 2006.

(51) Int. Cl.

| | |
|---|---|
| ***A45D 7/06*** | (2006.01) |
| ***A45D 40/26*** | (2006.01) |
| ***A46B 15/00*** | (2006.01) |

(52) U.S. Cl.

USPC ..... 132/200; 132/218; 132/313

(58) Field of Classification Search

USPC ..... 132/200, 216, 218, 313, 317, 318, 132/320; 401/1, 2, 118; D28/7; 206/581, 206/223

See application file for complete search history.

(56) References Cited

U.S. PATENT DOCUMENTS

| | | | | |
|---|---|---|---|---|
| 3,955,064 | A * | 5/1976 | Demetrio et al. | 219/225 |
| 5,052,839 | A | 10/1991 | Pettengill | |
| 5,775,344 | A * | 7/1998 | Clay | 132/218 |
| 7,090,420 | B2 | 8/2006 | De La Poterie et al. | |
| 7,108,438 | B2 | 9/2006 | Fontaine | |
| 2005/0000850 | A1 * | 1/2005 | Young | 206/581 |
| 2005/0013838 | A1 | 1/2005 | De La Poterie | |
| 2005/0031400 | A1 * | 2/2005 | Marcotte et al. | 401/129 |
| 2005/0061348 | A1 * | 3/2005 | Patel et al. | 132/218 |
| 2005/0191110 | A1 * | 9/2005 | Bitton | 401/52 |
| 2006/0130868 | A1 | 6/2006 | Noel | |
| 2007/0095810 | A1 * | 5/2007 | Gniadek | 219/225 |
| 2008/0006287 | A1 * | 1/2008 | Gueret | 132/218 |

FOREIGN PATENT DOCUMENTS

| | | |
|---|---|---|
| FR | 2 852 795 | 3/2003 |
| FR | 2 853 505 | 4/2003 |
| FR | 2 857 255 | 4/2003 |
| FR | 2 857 256 | 4/2003 |
| WO | WO 2004/073662 | 9/2004 |
| WO | WO 2006090343 A1 * | 8/2006 |

OTHER PUBLICATIONS

International Search Report from counterpart application No. PCT/EP2007/063547; Report dated Apr. 29, 2008.

* cited by examiner

*Primary Examiner* — Theodore Stigell
*Assistant Examiner* — Niyati D Shah
(74) *Attorney, Agent, or Firm* — Miller, Matthias & Hull LLP

(57) ABSTRACT

A kit for applying a mascara composition comprising several tanks respectively containing different mascara compositions and one or several application device for the mascara compositions, the application device comprising a cap and a rod provided with a heatable applicator element.

2 Claims, 2 Drawing Sheets

KIT FOR APPLYING A COSMETIC COMPOSITION

CROSS-REFERENCE TO RELATED APPLICATIONS

This application is a U.S. national stage filing of International Patent Application No. PCT/EP2007/063547 filed on Dec. 7, 2007, which claims priority under the U.S. Patent Application No. 60/873,273, filed on Dec. 7, 2006.

FIELD OF THE DISCLOSURE

The present invention relates to a kit for applying a mascara make up and/or keratinic fibers healthcare composition, in particular on eyelashes, said kit comprising a set of conditioning and application means of said composition provided with heating means.

BACKGROUND OF THE DISCLOSURE

Several devices of conditioning and application of mascara type cosmetic compositions provided with heating means have been disclosed in the prior art, in particular in FR patents 2 853 505, 2 852 795, 2 857 255 or 2 857 256 in the name of L'OREAL. In these documents, the heating means can be located in the conditioning device (also called tank) comprising the cosmetic composition to be applied, or in the application device constituted in general by holding means fixed to a rod whose end is provided for example with a brush.

However, despite the numerous disclosures on mascara devices, there is still a need for a device allowing at the same time to thicken, give volume, elongate, curve and give a deep dense colour effect to keratinic fibers, particularly to eyelashes. With the mascaras available on the market, problems still in general occur concerning the forming of packs on the eyelashes, dry texture, insufficient curving.

SUMMARY OF THE DISCLOSURE

Thus, this is an object of the present invention to provide a kit for applying a mascara make up and/or keratinic fibers healthcare composition, in particular on eyelashes, comprising:

- at least two tanks or conditioning devices each including a mascara make up and/or keratinic fibers healthcare composition, each composition contained in one tank or conditioning device being different from the composition contained in another tank or conditioning device,
- at least an application device of said mascara make up and/or keratinic fibers healthcare composition, said application device comprising:
- holding means or cap provided with heating means,
- a rod being adapted to be jointed to said holding means or cap (4), said rod (6) having an end which is provided with an applicator element being adapted to be heated by said heating means.

Application device is intended to be inserted into the conditioning device or tank to take a dose of mascara make up composition and/or keratinic fibers healthcare composition contained in said tank by means of an applicator element.

Once the applicator element and the rod have been introduced in the conditioning or tank device, the holding means or cap will be screwed in the conditioning device or tank, to close the tank with the holding means or cap in order to form a set of application and conditioning, also called mascara.

According to an embodiment of the invention, when the holding means or cap provided by the kit is fixed to the rod whose end is provided with an applicator element, it will be necessary to join said holding means at the free end of the rod in order to prepare the application device.

By "different compositions" as used in the specification and the claims, is meant compositions having different effects from one to the other. Thus, a composition contained in a first tank could for example essentially give an effect of thickness and volume with respect to the eyelashes, whereas a composition contained in a second tank could for example essentially give an effect of elongation and curving of the eyelashes. In the same way, a composition contained in a third tank could for example essentially give a deep dense colour to the eyelashes.

Advantageously with the kit of the invention, several compositions are provided with each presents a very specific and simplified texture, thus allowing to obtain an increased effect for each composition.

By using the kit of the invention, it is then possible to simultaneously thicken, give volume, brush, elongate, curve and give a deep dense colour to the eyelashes.

According to a preferred embodiment of the invention, the kit of the invention comprises the same number of tanks or conditioning devices as the number of applicator elements.

It will be the case, for example, when the holding means or cap is fixed to the rod whose end is provided with an applicator element, without possibility to separate them from each other, and the tanks contain compositions with different colours.

According to still another preferred embodiment of the invention, the kit comprises only one holding means or cap and at least two rods whose end are provided with an applicator element.

According to still another preferred embodiment of the invention, the kit comprises only one holding means or cap and the number of rods whose ends are provided with an applicator element is equal to the number of tanks or conditioning devices.

It will be the case, for example, when the holding means or cap has to be fixed to the rod, and the tanks contain compositions with different colours.

According to still another preferred embodiment of the invention, the kit comprises only one application device and at least two tanks or conditioning devices.

It will be the case, for example, when the holding means or cap is fixed to the rod, without possibility to separate them from each other, and the tanks contain compositions with same colours but with different effects.

The applicator element of the application device can advantageously be a brush. The brushes which will be used will be or not different regarding, for example, their shape and nature, depending on the desired effects. Appropriate brushes will be made with hair or soft disks.

The holding means or cap of the application device comprises a commutator and a warning light.

The commutator disposed on the external part of the holding means or cap is intended to activate the heating means located within the holding means.

The warning light located on the external part of the holding means or cap will switch off when the desired temperature is obtained.

The heating means of the application device comprises a heating resistance and batteries.

Said heating means allow to heat the applicator element. The introduction of the applicator element into the mascara make up composition allows loading said applicator element with a dose of the mascara make up composition. When the applicator element is heated, it will also heat the mascara composition when it comes into contact with the same. Thus loaded and heated the dose of mascara composition has maximal esthetical effects.

It is generally accepted that a temperature from 60 to 70° C. allows good conditions to work the eyelashes without burning them.

Such temperatures will be reached about four to five minutes after the commutator has been stimulated by his user.

It is also an abject of the present invention to provide a cosmetic method for make up and/or for non therapeutical healthcare of keratinic materials, comprising at least two consecutive applications on the keratinic materials of at least two different mascara make up compositions and/or keratinic fibers healthcare composition by using the kit as described above.

According to a preferred embodiment of the invention, the cosmetic method as described above comprises successively:

- a first application at room temperature of a mascara make up and/or keratinic fibers composition on keratinic materials to thicken and give volume to said keratinic materials,
- a second application under warm conditions of a mascara make up and/or keratinic fibers composition on keratinic materials to brush, elongate and curve said keratinic materials,
- a third application under warm conditions of a mascara make up and/or keratinic fibers composition on keratinic materials to give a deep dense colour effect.

However, the steps could be carried out in a different order, by starting with a first application under warm conditions and ending with an application at room temperature.

The cosmetic process of the present invention as described above is more particularly applied to the eyelashes.

BRIEF DESCRIPTION OF THE DRAWINGS

The invention will be better understood in the light of the drawings. These drawings are only indicative and are not limitative to the present invention. They show.

DETAILED DESCRIPTION OF THE DISCLOSURE

Figure 1:
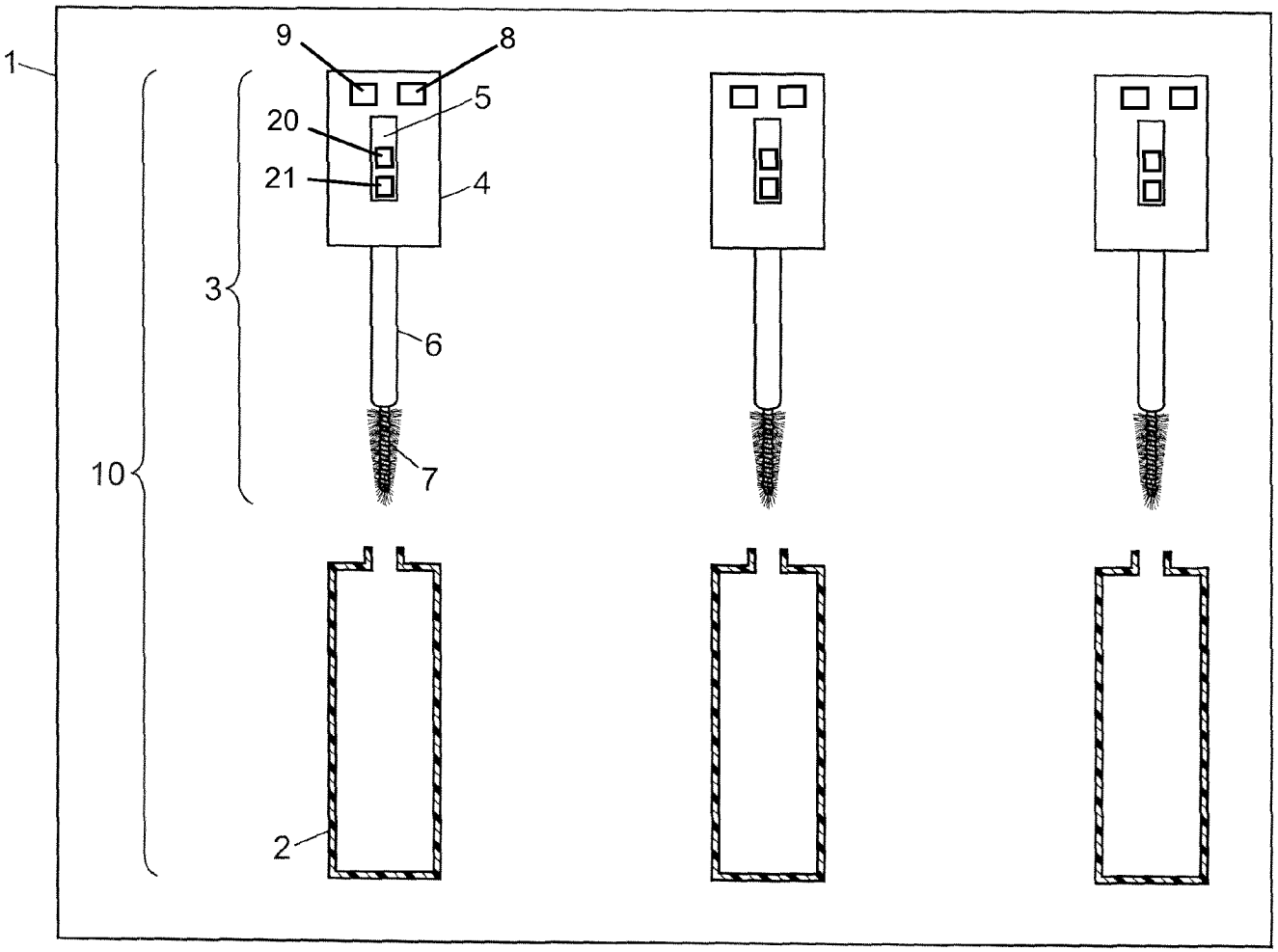
FIG. 1: a kit according to a preferred embodiment of the invention, comprising three tanks or conditioning devices and three application devices.
Figure 2:
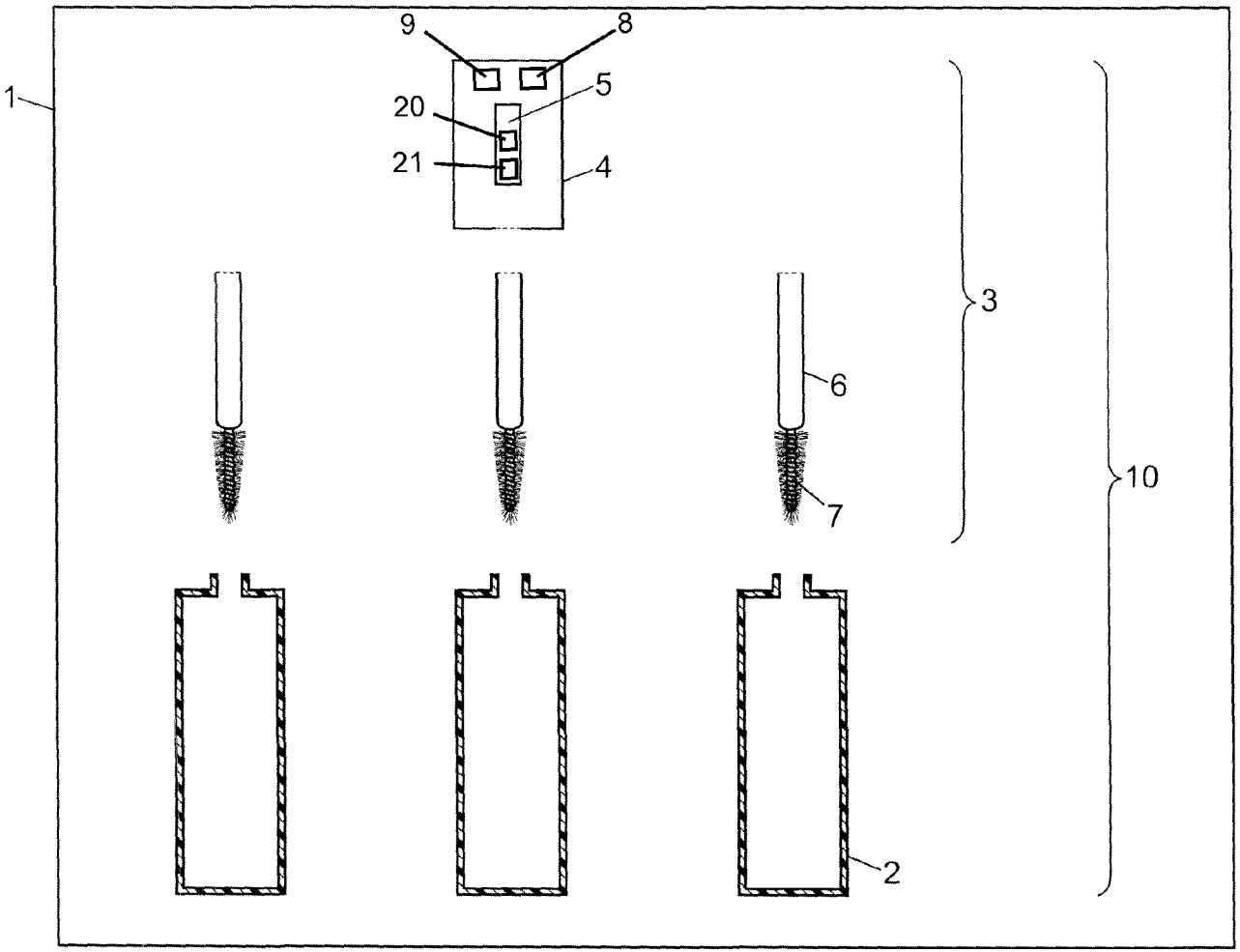
FIG. 2: a kit according to another preferred embodiment of the invention, comprising three tanks or conditioning devices, three rods whose ends are provided with an applicator element and one holding means or cap.

For a better understanding of the present invention, FIGS. 1 and 2 represent respectively a set of conditioning and application 10 in an open position, that is to say the application device 3 is not represented inserted and screwed in the tank or conditioning device 2 in order to be in a closed position and thus to form a closed set of conditioning and application 10.

However, according to the present invention the set of conditioning and application 10 is present into the kit 1 in a closed position.

FIG. 1 shows a kit 1 for applying a mascara make up and/or keratinic fibers healthcare composition, in particular on eyelashes, comprising:

- at least two tanks or conditioning devices 2, (in the example of FIG. 1, the kit 1 includes three tanks 2), each including a mascara make up and/or keratinic fibers healthcare composition, each composition contained in one tank or conditioning device 2 being different from the composition contained in another tank or conditioning device 2 (for example, a first composition contained in the first tank 2 could essentially give an effect of thickness and volume with respect to the eyelashes, whereas a second composition contained in the second tank 2 could essentially give an effect of elongation and curving of the eyelashes, and a third composition contained in the third tank 2 could essentially give a deep dense colour to the eyelashes),
- at least an application device 3 for said mascara make up and/or keratinic fibers healthcare composition (in the example of FIG. 1, the kit 1 includes three application devices 3), each application device 3 comprising a holding means or cap 4 provided with heating means 5, said holding means or cap 4 being jointly fixed to a rod 6, whose end is provided with an applicator element 7 (such as a brush or similar) being adapted to be heated by said heating means 5.

Application device 3 is intended to be inserted into the conditioning device or tank 2 to take a dose of mascara make up composition and/or keratinic fibers healthcare composition contained in said tank 2 by means of the applicator element 7.

Once the applicator element 7 and the rod 6 have been introduced in the tank or conditioning device 2, the holding means or cap 4 will be screwed in the conditioning device or tank 2, to close the tank 2 with the holding means or cap 4 in order to form a set of application and conditioning 10.

By using the kit 1 of the invention, it is then possible to simultaneously thicken, give volume, brush, elongate, curve and give a deep dense colour to the eyelashes.

The holding means or cap 4 of the application device 3 comprises a commutator 8 and a warning light 9. The commutator 8 disposed on the external part of the holding means or cap 4 is intended to activate the heating means 5 located within the holding means 4. The warning light 9 located on the external part of the holding means or cap 4 will switch off when the desired temperature is obtained.

The heating means 5 of the application device 3 comprises a heating resistance 20 and batteries 21. Said heating means 5 allows to heat the applicator element 7, in a manner known per se (the resistance of the heating means may be inserted for instance in the rod 6 bearing the brush 7). When the applicator element 7 is heated, it will also heat the mascara composition when it comes into contact with the same. Thus, the heated dose of mascara composition loaded on the applicator element 7 has maximal esthetical effects. It is generally accepted that a temperature from 60 to 70° C. allows good conditions to work the eyelashes without burning them. Such temperatures will be reached for instance about four to five minutes after the commutator 8 has been actuated by his user.

The kit 1 described above enables to provide a new cosmetic method for make up and/or for non therapeutical healthcare of keratinic materials, comprising at least two consecutive applications on the keratinic materials of at least two different mascara make up compositions and/or keratinic fibers healthcare composition by using the kit as described above.

In the example of FIG. 1, the cosmetic method as described above, comprises successively:

- a first application at room temperature of the first composition on keratinic materials to thicken and give volume to said keratinic materials, a second application under warm conditions of the second composition on keratinic materials to brush, elongate and curve said keratinic materials, a third application under warm conditions of the third composition on keratinic materials to give a deep dense colour effect.

According to the embodiment represented in FIG. 2, the rods 6 whose ends are provided with an applicator element 7 are also inserted into tanks or conditioning devices 2 when the kit 1 is prepared. This second embodiment is similar to the embodiment of FIG. 1 and will therefore not be described in detail again. The embodiment of FIG. 2 distinguishes from that of FIG. 1 essentially in that the kit 1 comprises only one holding means or cap 4 and at three rods 6 each having an applicator element 7 (one rod for each tank 2 in this embodiment). Therefore, when using the kit 1, the holding means or cap 4 has to be successively fixed to the three rods 6.

In this embodiment, the heating means included in each rod 6 include an electrical connector which connects to a complementary electrical connector of the cap 5 when the rod is coupled to the cap.

The invention claimed is:

1. A cosmetic method for make up and/or for non therapeutical healthcare of keratinic materials, comprising successively:

a first application at room temperature of a mascara make up and/or keratinic fibers composition on keratinic materials to thicken and give volume to said keratinic materials;

a second application under warm conditions of a mascara make up and/or keratinic fibers composition on keratinic materials to brush, elongate, and curve said keratinic materials, and a third application under warm conditions of a mascara make up and/or keratinic fibers composition on keratinic materials to give a deep dense colour effect.

2. The cosmetic method according to claim 1, wherein it is applied to eyelashes.

* * * * *